US005381972A

United States Patent [19]

Chon et al.

[11] Patent Number: 5,381,972

[45] Date of Patent: Jan. 17, 1995

[54] DOWNDRAFT SHREDDER

[75] Inventors: David N. Chon, Baltimore, Md.; Andrew V. Maynard, West Palm Beach, Fla.

[73] Assignee: The Babcock & Wilcox Company, New Orleans, La.

[21] Appl. No.: 293,333

[22] Filed: Aug. 24, 1994

Related U.S. Application Data

[63] Continuation of Ser. No. 74,511, Jun. 11, 1993, abandoned.

[51] Int. Cl.[6] ..... B02C 13/284

[52] U.S. Cl. ..... 241/73; 241/189.1

[58] Field of Search ..... 241/73, 89.3, 89.4, 241/188.1, 189.1

[56] References Cited

U.S. PATENT DOCUMENTS

| | | | |
|---|---|---|---|
| 3,339,851 | 9/1967 | Felton et al. | 241/89.4 |
| 3,627,212 | 12/1971 | Stanton | 241/73 |
| 4,009,836 | 3/1977 | Strom et al. | 241/73 |
| 4,383,652 | 5/1983 | Osborne et al. | 241/89.3 |
| 4,664,317 | 5/1987 | Morton | 241/89.3 |
| 4,664,320 | 5/1987 | Steffens | 241/189.1 |
| 4,720,051 | 1/1988 | Graveman et al. | 241/189.1 |
| 4,778,114 | 10/1988 | Panning | 241/189.1 |
| 5,150,844 | 9/1992 | McKie | 241/73 |

*Primary Examiner*—Timothy V. Eley
*Attorney, Agent, or Firm*—Robert J. Edwards

[57] ABSTRACT

A downdraft shredder comprising a lower housing, a semicircular lower grate, a chute for supplying material to a rotor cavity and a hood for covering the remainder of the rotor cavity. A rotor with hammers is rotatably mounted in the rotor cavity and draws material from the chute against the lower grate for shredding the material. A plate extending in the hood from the rotor cavity to a back corner of the hood, allows air entrained by the rotor to stabilize thereby preventing an updraft of air through the chute. This produces a true downdraft shredder which represents a modification over known shredders.

4 Claims, 2 Drawing Sheets

DOWNDRAFT SHREDDER

This application is a continuation of application Ser. No. 08/074,511, filed Jun. 11, 1993, abandoned.

FIELD AND BACKGROUND OF THE INVENTION

The present invention relates in general to shredders, and in particular to a shredder which produces a downdraft effect when shredding the material which is supplied to the top of the shredder.

Shredders are pieces of equipment used in a variety of industries with numerous designs to suit different applications. Typically, a shredder consists of an enclosed rotor with any number of hammers attached to the rotor by means of hammer pins. The rotor is spun at a high speed by either an electric motor or a diesel engine. When material is fed into the shredder, impact is made with the feed material by the heavy high speed hammers, resulting in the reduction in particle size of the feed material. Grate bars are located directly beneath the spinning hammers and are designed to cause impact with the material being shredded by the hammers and to control the desired particle size of the shredded material. The larger the grate openings, the larger the particle size.

Most shredders produce an updraft of air and particles blowing back up the inlet in an undesired manner as a result of the draft set up by the rapidly spinning hammers, and because of the dynamics of the falling material being supplied to the shredder. The preferred shredder would be one which produces a natural downdraft effect thereby drawing air as well as the feed material into the shredder inlet and into engagement with the rotating hammers.

Most shredder manufacturers claim to have the technology to construct a single direction downdraft shredder. However, once constructed, installed and operational, many of these shredders are actually updraft rather than downdraft shredders. The inventors are not aware of any known technology which would enable one to convert an existing updraft single direction shredder to a downdraft shredder.

SUMMARY OF THE INVENTION

The present invention comprises a design for converting or modifying an existing single direction updraft shredder to a downdraft shredder.

In order to convert a single direction updraft shredder to the more efficient downdraft shredder, the turbulent air caused by the spinning hammers must be relieved before the hammers enter the feed chamber. This is achieved by removing the shredder hood grates, generally located between the 12 and 3 o'clock quadrant of the hammer rotation, and replacing them with a heavily constructed steel plate connecting the leading edge of the lower grate to the back corner of the hood. The steel plate acts to relieve the pressure and air turbulence in the rotor cavity thereby allowing air to be easily pushed by the hammers downwardly between the hammer tips and grate bars.

Downdraft shredders offer superior performance over updraft shredders for several reasons. Downdraft in a shredder minimizes the amount of dust and debris escaping from the feed chamber and shredder vent. A downdraft shredder experiences less mulching or overgrinding resulting in a cost savings due to a decrease in horsepower consumption and a reduction in hammer and grate wear. The feed material in a downdraft shredder is forced through the grate openings shortly after the material has been reduced to an acceptable size as determined by the grate openings thereby making the control of particle size possible while also allowing for the introduction of more feed material.

Accordingly, an object of the present invention is to provide a downdraft shredder comprising a lower housing; a semicircular lower grate in the lower housing having a leading edge and a trailing edge; a chute for receiving material to be shred and being connected to the lower housing, the chute having an inlet opening and a feed chamber; a hood over a portion of the lower housing and adjacent the chute; the hood having a back corner spaced away from the chute; the hood cooperating with the chute and the lower grate to define a rotor cavity; a hammer rotor mounted for rotation in the rotor cavity in a direction from across the feed chamber, then across the lower grate and thereafter across the hood; a plurality of hammers connected at spaced locations around the rotor for interacting with the lower grate to shred material from the feed chamber and through the lower grate into the lower housing; and a plate extending from the trailing edge of the lower grate to the back corner of the hood so that air entrained by the hammers in the rotor cavity passes into the hood from the feed chamber to insure a downdraft of air from the chute into the rotor cavity.

A further object of the present invention is to provide a mechanism for converting an existing updraft shredder to a more advantageous downdraft shredder, with minimum modifications.

A still further object of the invention is to provide a downdraft shredder which is rugged in construction and economical to manufacture.

The various features of novelty which characterize the invention are pointed out with particularity in the claims annexed to and forming a part of this disclosure. For a better understanding of the invention, its operating advantages and the specific objects attained by its uses, reference is made to the accompanying drawings and descriptive matter in which a preferred embodiment of the invention is illustrated.

DESCRIPTION OF THE PREFERRED EMBODIMENT

Figure 1:
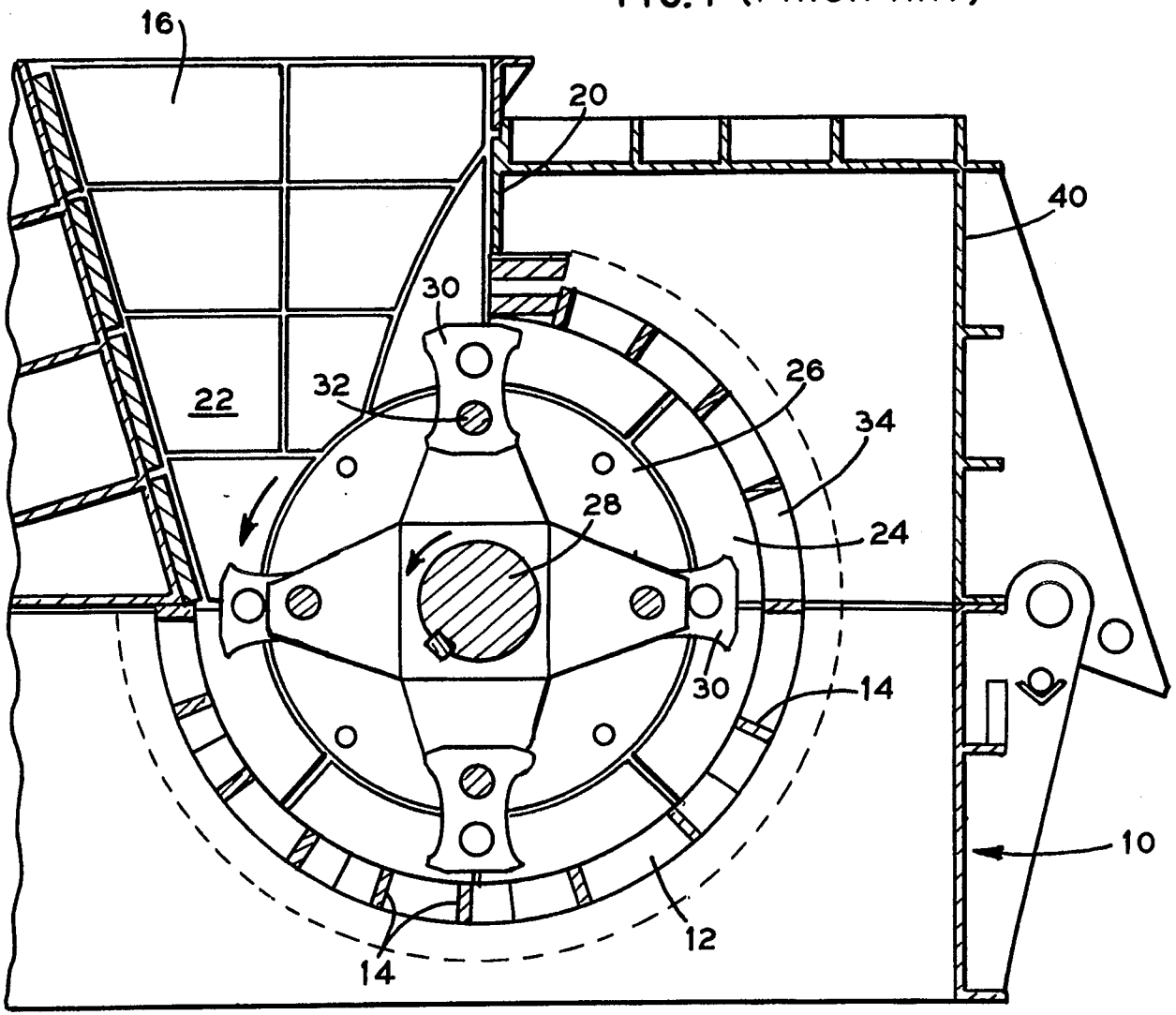
FIG. 1 (PRIOR ART)
FIG. 1 is a side sectional view of a known shredder having an undesirable updraft effect to be avoided according to the present invention.

Referring to the drawings and particularly to the conventional shredder in FIG. 1 there is shown a lower housing 10 having side walls and rear walls for defining a space that contains a semicircular lower grate 12 made up of curved plates with elongated grate bars 14 connected therebetween, for example, by welding. The space between the bars 14 defines the grate size and thus the size of the shredded particles.

A chute 16 having an upper open inlet for receiving material to be shredded or feed material, includes a front wall 18 and a rear wall 20 as well as side walls which define a feed chamber 22 at the inlet end of a cylindrical cavity 24 which is defined by four quadrants numbered in a counter-clockwise direction, i.e., a first quadrant from 12 to 9 o'clock, a second quadrant from 9 to 6 o'clock, a third quadrant from 6 to 3 o'clock, and a fourth quadrant from 3 to 12 o'clock. A rotor 26 carried by a shaft 28 is mounted for rotation within the rotor cavity 24. A plurality of hammers 30, in this case four, are connected by hammer pins 32 at spaced locations around the rotor 26. In the shredder shown at FIG. 1, the rotor rotates counter-clockwise, as indicated by the arrows, and shreds the feed material by interacting with the lower grate 12 and with an upper hood grate 34 comprised of additional grate bars. A top wall, front and rear walls and side walls together form a hood 40 which covers that portion of the housing 10 which is not covered by chute 16 i.e., the fourth quadrant of cavity 24. The chute 16 occupies the entire first quadrant. The hood 40 cooperates with the grates 12 and 34 which occupy the lower second and third quadrants and the feed chamber 22 to define the remainder of the rotor cavity 24. The prior art shredder shown in FIG. 1 has a tendency to produce an updraft of air flowing upwardly through the chute 16 carrying dust and disturbing the feed material in the chute 16. Additionally, there exists a problem of over-mulching or over-shredding of the material as it recirculates in the chute 16 and is reintroduced time and again to the hammers in the feed chamber 22. The updraft is believed to be caused by compressed turbulent air being entrained by the rotating hammers thereby forcing the air into the housing 10 and hood 40.

Figure 2:
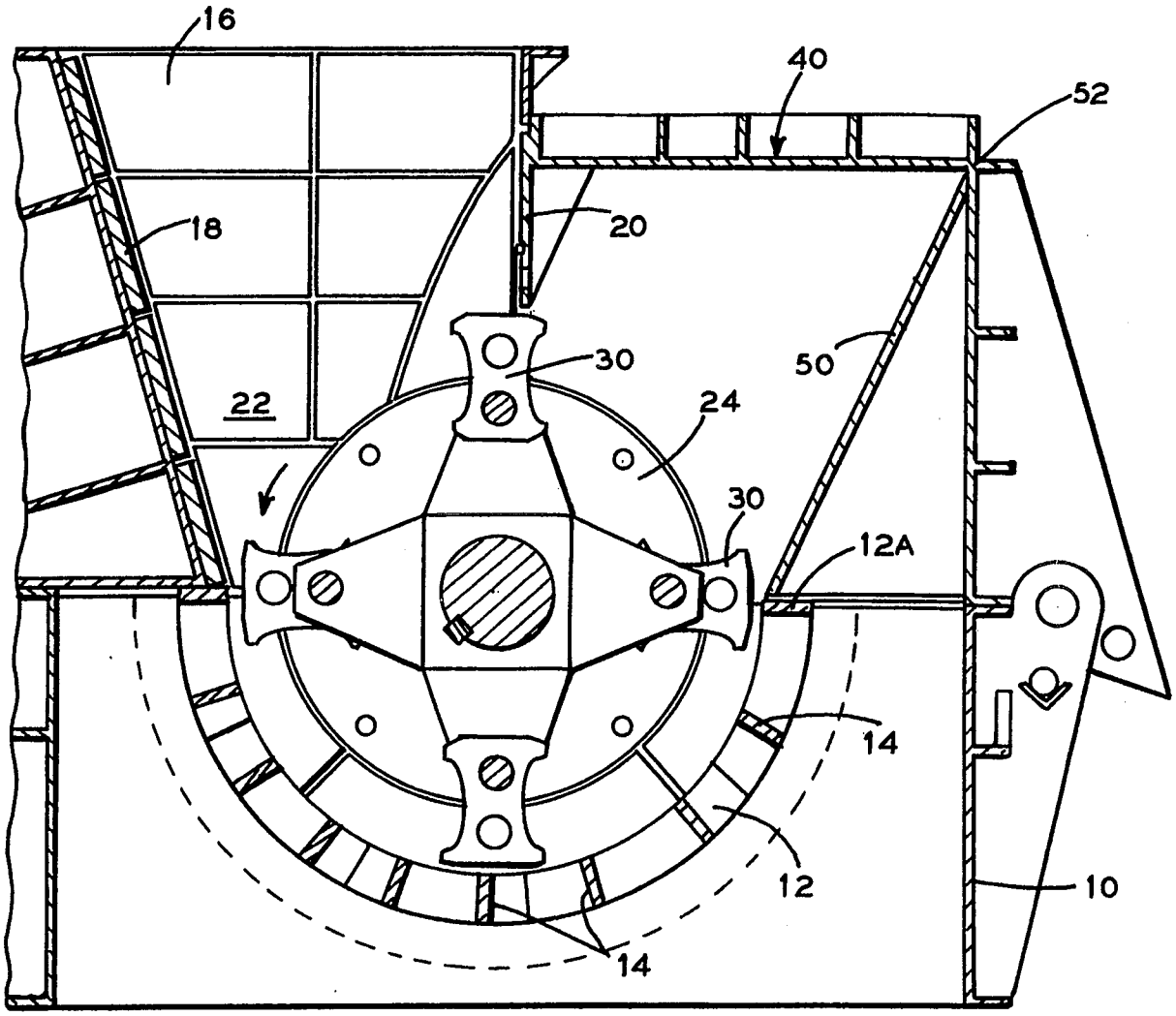
FIG. 2 is a side sectional view of a shredder modified, in accordance with the present invention, to be a downdraft shredder.

FIG. 2 uses the same reference numerals as FIG. 1 to designate the same or functionally similar parts. The description is limited to those parts which embody the invention. According to the invention, the upper grate shown at 34 in FIG. 1 is removed and replaced with an inclined or upwardly oriented steel plate 50 extending from the trailing edge 12*a*, of the lower grate 12, at a location between the third and fourth quadrants up to the back corner 52 of the hood 40. This opens the space within the hood which is now only separated from the feed chamber 22 by the side wall or vertical partition wall 20 of the chute 16 which extends radially downwardly to the rotor cavity 24 between the first and fourth quadrants. Thus, as the hammers 30 rotate in the counter-clockwise direction, the air entrained by the hammers 30 in the feed chamber 22 has time to leak back into the hood 40 or be entrained around the rotor cavity 24 for passage into the hood 40, along the plate 50. This has been found to unexpectedly and advantageously produce a true downdraft in the chute 16 that keeps the dust in the shredder and avoids the lifting or recirculating of the feed material thereby increasing the through-put of material, decreasing power consumption and reducing wear on the hammers.

While a specific embodiment of the invention has been shown and described in detail to illustrate the application of the principles of the invention, it will be understood that the invention may be embodied otherwise without departing from such principles.

What is claimed is:

1. A downdraft shredder comprising:

a lower housing;

a semicircular lower grate in the lower housing having a leading edge and a trailing edge;

a chute for receiving material to be shred, the chute being connected to the lower housing and having an inlet opening and a feed chamber;

a hood located over a portion of the lower housing and adjacent the chute, the hood having a back corner spaced away from the chute and cooperating with the chute and the lower grate to define a cylindrical rotor cavity having a first quadrant at which the chute is positioned, the chute occupying the entire first quadrant, lower second and third quadrants covered by the lower grate, and a fourth quadrant covered by the hood;

a vertical partition wall extending between the hood and the chute and radially downwardly to said rotor cavity between the first and fourth quadrants;

a hammer rotor mounted for rotation in the rotor cavity in a direction from across the feed chamber in the first quadrant, then across the lower grate in the second and third quadrants and thereafter across the hood in the fourth quadrant;

a plurality of hammers connected at spaced locations around the rotor for interacting with the lower grate to shred material from the feed chamber and through the lower grate into the lower housing; and a plate extending from the trailing edge of the lower grate at a location between the third and fourth quadrants, to the back corner of the hood so that air entrained by the hammers in the rotor cavity passes into the hood from the feed chamber to insure a downdraft of air from the chute into the rotor cavity.

2. A shredder according to claim 1, wherein the plate comprises an inclined steel plate extending from the trailing edge of the lower grate to the back corner of said hood.

3. A shredder according to claim 1, including a pin for connecting each hammer to said rotor.

4. A shredder according to claim 1, including a rotor shaft rotatably mounted to the lower housing and carrying said rotor.

* * * * *